US005415570A

United States Patent [19]

Sarkissian

[11] Patent Number: 5,415,570

[45] Date of Patent: May 16, 1995

[54] MODULAR CONNECTOR WITH CONTACTS ASSOCIATED WITH MORE THAN ONE SURFACE

[75] Inventor: Haig A. Sarkissian, Bedminster, N.J.

[73] Assignee: AT&T Corp., Murray Hill, N.J.

[21] Appl. No.: 997,980

[22] Filed: Dec. 28, 1992

[51] Int. Cl.[6] ..... H01R 13/00

[52] U.S. Cl. ..... 439/676; 439/660

[58] Field of Search ..... 439/676, 660, 692, 697

[56] References Cited

U.S. PATENT DOCUMENTS

| | | | |
|---|---|---|---|
| 3,963,300 | 6/1976 | Patton et al. | 439/676 |
| 4,103,985 | 8/1978 | Krolak et al. | 439/676 |
| 4,225,209 | 9/1980 | Hughes | 439/676 |
| 4,290,664 | 9/1981 | Davis et al. | 439/676 |
| 4,362,905 | 12/1982 | Ismail | 439/676 |
| 4,493,951 | 1/1985 | Sandersson et al. | 439/676 |
| 4,655,522 | 4/1987 | Beck, Jr. et al. | 439/676 |
| 4,679,879 | 7/1987 | Friner et al. | 439/676 |
| 5,118,312 | 6/1992 | Lu | 439/676 |
| 5,244,402 | 9/1993 | Pasterchick, Jr. et al. | 439/676 |

*Primary Examiner*—Daniel W. Howell
*Attorney, Agent, or Firm*—Henry T. Brendzel

[57] ABSTRACT

A new female connector and a corresponding new male connector that are compatible with the FCC 68.500 subpart F standard connectors. Specifically, the new modular male connector includes electrical contacts in association with at least two surfaces of the generally rectilinear connector. Corresponding electrical contacts are included in the female connector to mate with the electrical contacts in the male connector.

15 Claims, 4 Drawing Sheets

MODULAR CONNECTOR WITH CONTACTS ASSOCIATED WITH MORE THAN ONE SURFACE

BACKGROUND OF THE INVENTION

This invention relates to modular connectors and more particularly to modular telephone connectors.

Standard modular telephone connectors conform to FCC specification section 68.500, subpart F (standard 68.500) and contain 2, 4, or 6 contacts. Some even contain 8 contacts. This "standard 68.500" is hereby incorporated by reference. In its most basic form, a telephone connector needs only two contacts to accommodate the "tip" and "ring" of a conventional telephone, but more contacts are provided to accommodate various auxiliary optional functions. In data applications where a modem is interposed between data communication equipment and the telephone network, the output port of such a modem is often presented via the female modular telephone connector.

Such a port serves well in a wired environment, but in a wireless environment the modem needs to be connected to a wireless transceiver, and the question is how to connect the modem with its standard, modular, female, telephone connector to the wireless transceiver. Fortuitously, wireless telephones (hereinafter "PCDs", meaning Personal Communication Devices) typically include a multi-pin connector that allows for interaction with the PCD. Such interaction can comprise modifying the PCD's protocols modifying the ID number, or modifying any number of the PCD's operating features and capabilities. One other purpose to which the connector can be applied is to send data through the PCD to the telecommunication system with which the PCD interacts in a wireless manner and to provide a remote microphone and speaker connection.

Alas, the standard modular telephone female connector cannot be used to directly interface with the multi-pin connector of the PCD because the female connector at a modem's output port does not support the number of pins that are necessary to interface with the multi-pin connector of the PCD. The need, then, is for a connector that is both compatible with the standard telephone connector arrangement of standard 68.500 and is also capable of interacting with the multi-pin interface of PCDs.

SUMMARY OF THE INVENTION

This invention advances the art and fulfills the above-stated need through a new female connector and a corresponding new male connector. The new connectors are compatible with the 68.500 standard connectors, described above, in the sense that the new female connector can accept and work with a standard male connector, as well as accept and work with the new male connector. Correspondingly, the new male connector can connect to a standard female connector, as well as accept and work with the new female connector.

The basic improvement in the new connector comprises the placement of electrical contact surfaces in association with at least one additional face of the generally rectilinear male connector. Corresponding electrical contacts are included in the female connector to mate with the electrical contacts in the male connector.

DETAILED DESCRIPTION

Figure 1:
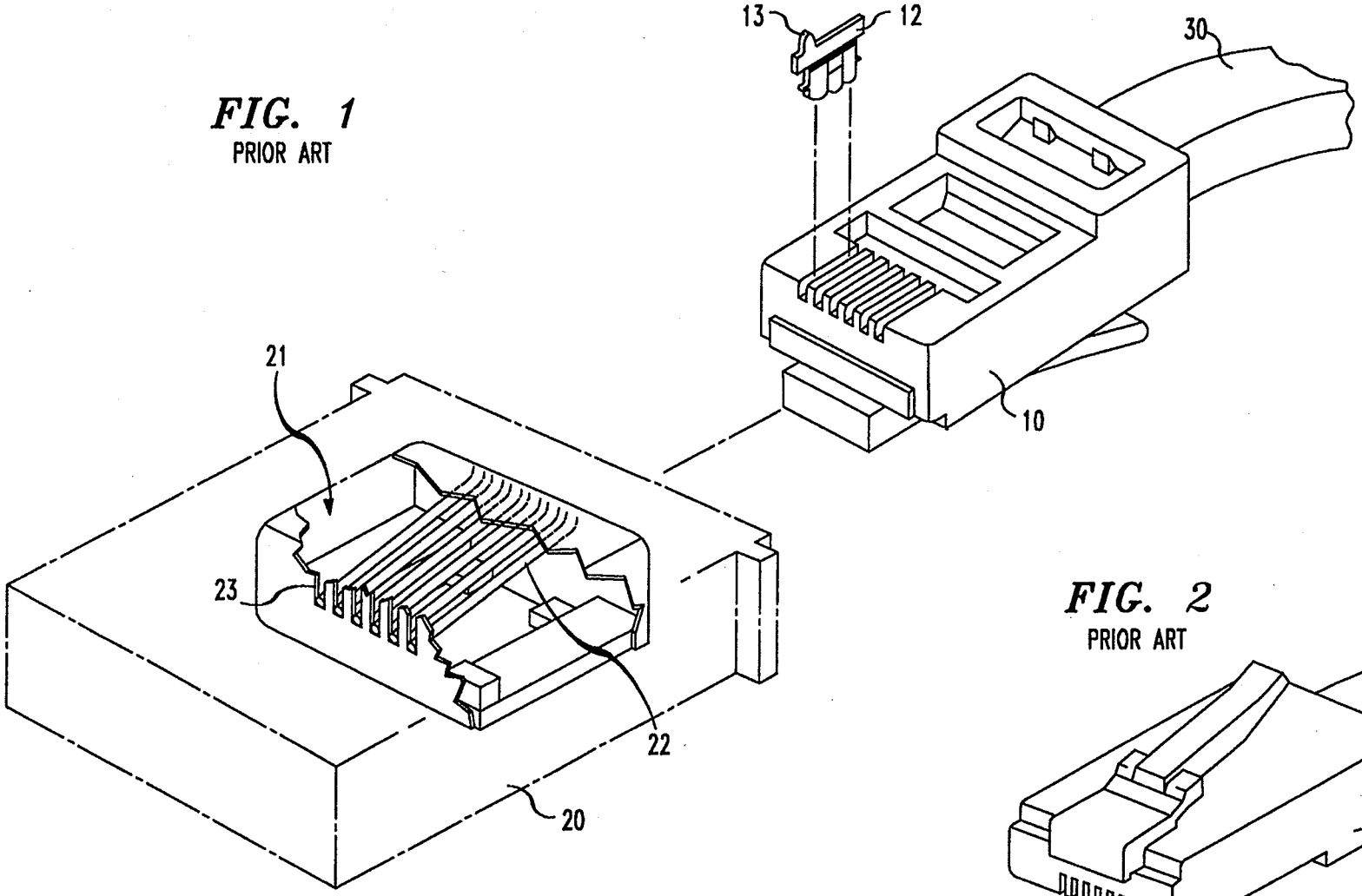
FIG. 1 PRIOR ART
FIG. 1 depicts the prior art arrangement of a male and a female modular telephone connector.

FIG. 1 depicts one embodiment of the standard modular, male and female telephone connectors 10 and 20, respectively. The general construction of plastic elements 10 and 20 is very well known, but for purposes of describing the instant invention, some aspects of the connectors are briefly summarized below. Specifically, attention is directed to a plurality of grooves 11 in element 10 and a metallic contact element 12 that is presented in exploded view. The exploded view intends to show the shape of element 12 which, in the assembled mode, is embedded in groove 11 (e.g., with the aid of applied heat) and placed in electrical contact with a conductor of cable 30.

Female element 20 includes a cavity 21 with an inner wall that contains slits 23. Resilient metallic wires 22 are arranged to extend from the ceiling surface of cavity 21 downwards toward slits 23. Wires 22 and slits 23 are positioned to mate wires 22 with grooves 11 when element 10 is inserted into element 20. As element 10 is inserted into element 20, the top surfaces of contact elements 12, i.e., surfaces 13, engage respective resilient wires 22 and push those wires upwards. The resilient forces of wires 22 create a positive contact between wires 22 and surfaces 13.

Figure 2:
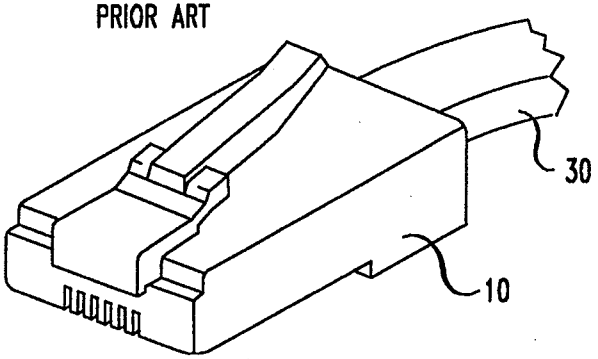
FIG. 2 PRIOR ART
FIG. 2 shows a different view of the connectors of FIG. 1.

FIG. 2 shows an isometric view of elements 10 and 20 that is different from that of FIG. 1. It depicts the "snap in" mechanism of elements 10 and 20.

Figure 3:
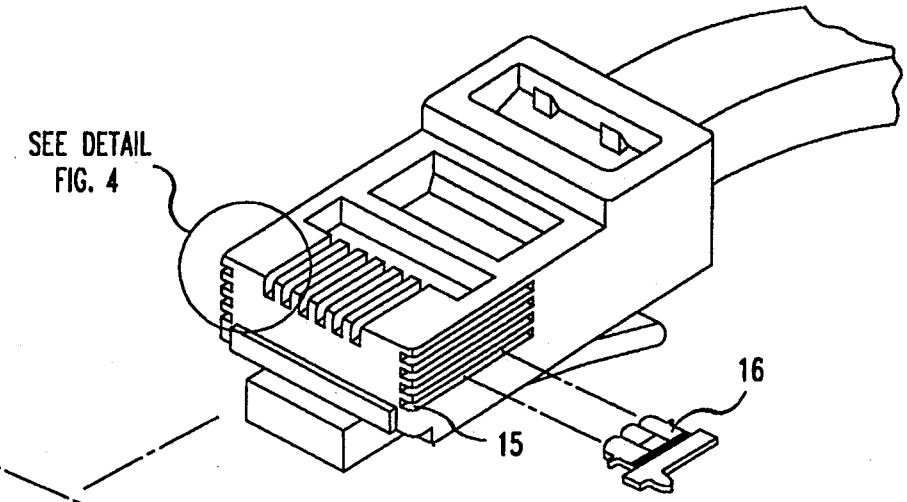
FIG. 3 illustrates one embodiment of the male and female modular connectors of this invention.
Figure 6:
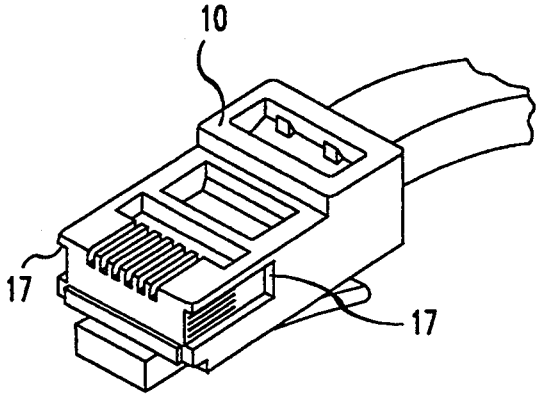
FIG. 6 presents another embodiment of a male modular connector in conformance with the principles of this invention.

As indicated above, the need is to have a telephone connector that is in conformance with the connection arrangement of FIG. 1 and also offers a number of additional contacts between elements 10 and 20. In accordance with the principles of this invention, this is achieved with a connector that adds to the contacts present in the FIG. 1 arrangement in a convenient way, without jeopardizing connection reliability. FIGS. 3 and 6 present two illustrative embodiments.

Figure 4:
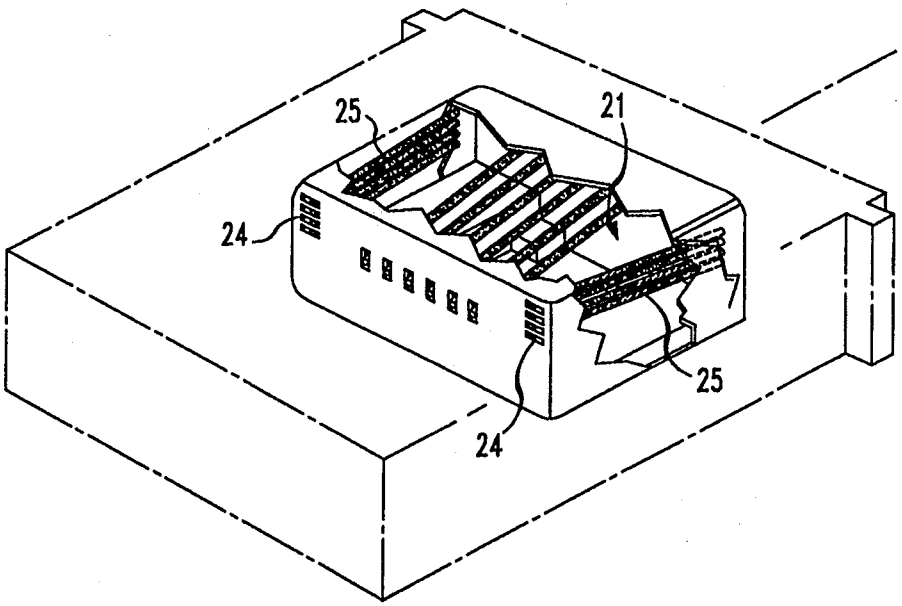
FIG. 4 presents an enlarged view of a portion of the male connector of FIG. 3.
Figure 4:
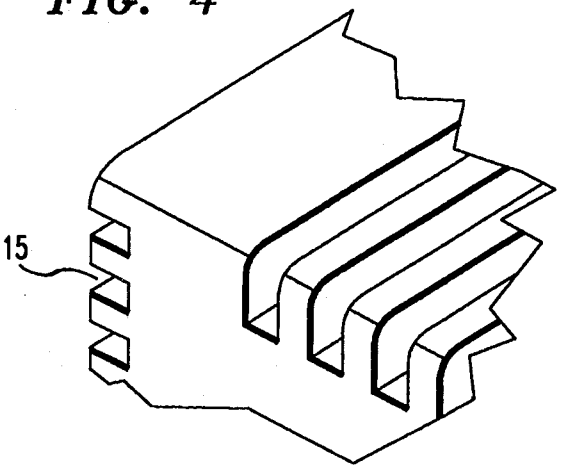

In FIG. 3, grooves 15 are included in the two opposite sides of element 10 that are adjacent to the side that contains contact elements 12, and associated with grooves 15 there are contact elements 16. The construction of grooves 15 and the connection of wires from cable 30 to contacts 16 is identical to that of grooves 11 and contacts 12. An enlarged view of grooves 15 is presented in FIG. 4.

Figure 5:
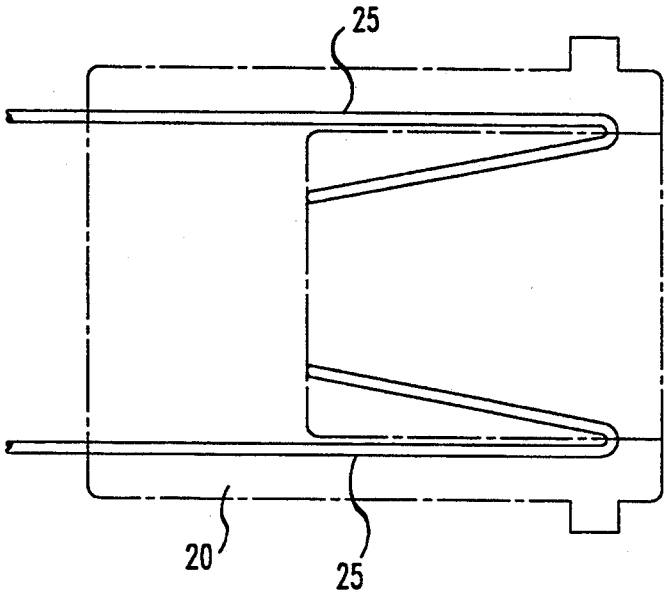
FIG. 5 illustrates the extension of contacts 25 to outside the body of female connector 20.

Corresponding to the additional grooves and contacts of element 10 shown in FIG. 3, the female element 20 shown in FIG. 3 also includes slits 24 and resilient metallic wires 25 in the two sides of cavity 21. The arrangement of wires 25 corresponds to the arrangement of wires 22 in FIG. 1. It is also arranged to mate with grooves 15. In the opposite direction from slits 24, wires 25 extend into the side walls of cavity 21 and are carried to the back of element 20, as depicted in FIG. 5. In FIG. 5 they are shown to exit element 20 at the back of element 20 (i.e., the side opposite the opening of cavity 20) but, of course, these wires can be bend downward and made to exit element 20 at its button surface; e.g., for soldering to a printed circuit board.

Grooves 11 serve the function of guiding wires 22. The need for grooves 11 arises primarily because various embodiments of elements 10 and 20 contain different numbers of wires 22. Absent the grooves, in the process of inserting a narrow plug 10 (i.e., with a small number of contacts 12) into a mode cavity 21 (i.e., with a larger number of wires 22), it is possible for a wire 22 to straddle two contact element 12. This is due to the possible lateral movement of plug 10 vis-a-vis element 20. Grooves 11 eliminate this possibility. Significantly, the need for grooves does not exist in connection with elements 16 and 25 because there are no variations in the height of element 10. Accordingly, the thickness of grooves 15 can be reduced substantially and the grooves can even be eliminated altogether. That provides room for a larger number of contacts 16 on each side of element 10.

FIG. 6 depicts such a grooveless embodiment. Therein, each side of element 10 includes a slight depression 17, and embedded in that depression are elements 16 in conformance with the prior art principles described in connection with FIGS. 1 and 3. It may be noted that even in the absence of grooves 15, contacts 16 must be separated from each other. This separation allows for the creation of slits 24 in element 20. However, if the separation is so small that slits 24 cannot be manufactured with sufficient operational integrity, holes can be molded into the side walls of cavity 21, close to the back surface of the cavity, in a zig-zag pattern, and wires 25 can be bent at their ends and made to enter those holes. Because of the holes' zig-zag pattern, the separation between holes is not wholly dependent on the separation between wires 25.

As was noted above, for purposes of normal telephone connections, only two contact elements 12 need to be devoted to the two conventional telephone signals known as "tip" and "ring". In such a mode of operation, signals flow in both directions through the tip and the ring. This condition is also referred to as "two wire" operation. Another mode of operation is "four wire" operation, where the signal in one direction flows through one pair of wires, and the signal in the opposite direction flows through another pair of wires. (Sometimes, one wire in each pair of wires is devoted to ground potential. In such circumstances a single wire could serve the function of the two ground potential wires.) As an aside, conversion from "two wire" operation to "four wire" operation is well-known. Every telephone performs such a conversion with a circuit commonly called the "hybrid".

In short, transmission channels typically operate either in the "two wire" mode (relying on the use of hybrids when necessary) or in the "four wire" mode (when circumstances so require). More relevantly to this invention, however, it is noted that in at least some of the wireless transceivers, the multi-pin connector comprises a "four wire" signal interface, while the standard telephone system operates with a "two wire" interface.

Figure 7:
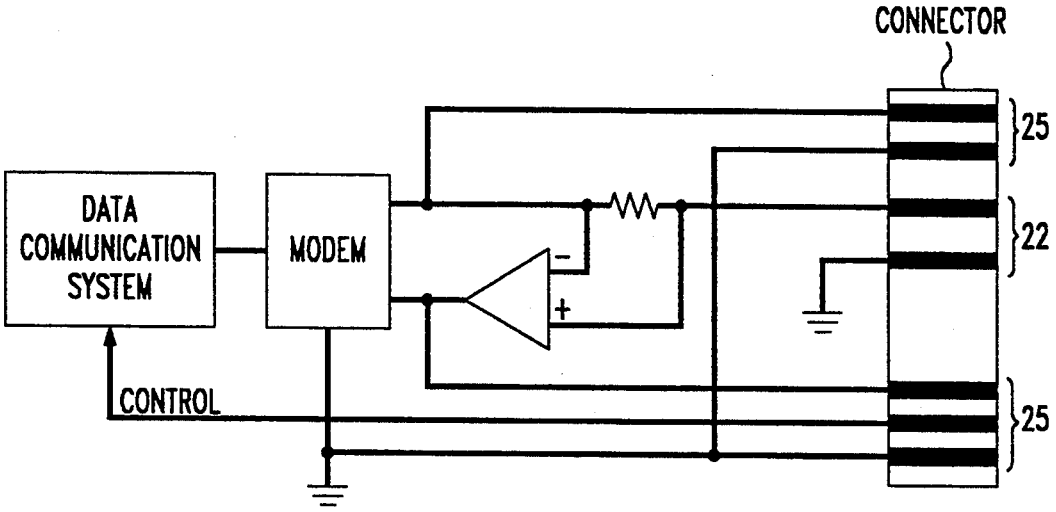
FIG. 7 presents a modem and a digital communication device connected to a connector of this invention.

To accommodate both interfaces in accordance with the principles of this invention, at least four signal paths are devoted in the connectors of this invention to the task of transmitting analog telephone traffic information: two for the "two wire" transmission, and two for the "four wire" transmission. The two signal paths for the "two wire" transmission are the standard two contacts from among contacts 12 and wires 22 (per standard 68.500), and the two other contacts are selected from among either other contacts 12 and wires 22, or contacts 16 and wires 25. FIG. 7 illustrates the additional connections to be contacts 16 and wires 25. The ground wire for each of the "four wire" paths can be connected to additional pins of the connector, as shown for example in FIG. 7, or can be connected to the "ring" contact (which may not be preferred in some situations).

Figure 8:
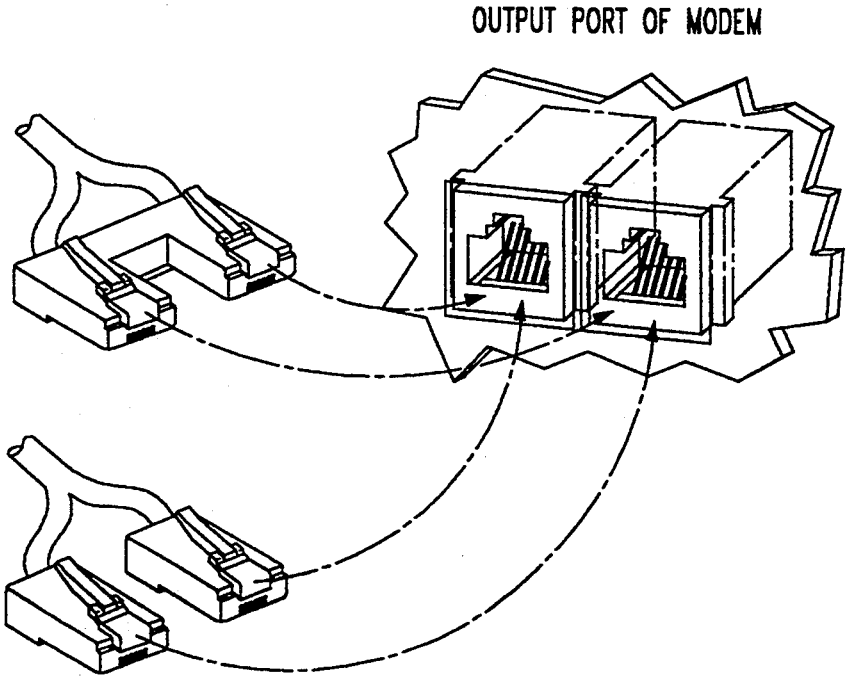
FIG. 8 illustrates connector arrangements formed from combinations of standard connectors.

Having described the connections of FIG. 7, FIG. 8 presents still another realization that achieves the needs present in the art.

Many modems already include two standard modular female connectors that are, in a sense, connected to the modem. Specifically, the two connectors have the standard "tip" and "ring" wires 22 connected in parallel and also connected to the modem's output. This allows one modular connector to be connected to the telephone system while the other modular connector to be connected to a conventional telephone. The interesting aspect of this present arrangement is that if each of the modular connectors includes six wires 22, for a total of twelve, and four are used for the "tip" and "ring", then eight wires are left for communicating signals to the multi-pin connector of the wireless transceiver. Connection to the wireless transceiver is via a unitary cable 60 that either terminates in two separate male modular connectors 61 and 62 that are joined to the common cable, or terminates in a new male connector 63 that resembles two conventional male modular connectors which are joined at their backs. By "unitary cable" is meant a cable that is made up of individual insulated conductors that are held together within a single sheath.

The connection to the modem of the two female modular connectors can thus follow in the footsteps of the connection described in FIG. 7. That is, some of the spare wires 22 can be used for the "four wire" signals and the remaining spare wires 22 can be used for control signals. Those connections are not explicitly depicted in FIG. 8 for sake of clarity of the drawing, but the teachings of FIG. 7 are incorporated therein.

The foregoing descriptions are presented as illustrative realizations of this invention. It should be realized, of course, that other embodiments can be structured that conform to the spirit and scope of this invention. For example, dual "snap in" mechanism depicted in connector 63 of FIG. 8 can have the ends thereof coupled to each other so that a push at a single point would disengage the mechanism from the two modular female connectors shown in FIG. 8. Also, the connectors in FIG. 8 can incorporate some of the additional contacts illustrated in FIGS. 3 and 6. Further, additional contacts can be incorporated into a portion of the surface opposite the surface that contains contacts 12.

I claim:

1. A unitary male plug connector having a first surface with a plurality of grooves, with a conductor in at least some of the grooves, the improvement comprising:

a collection of other contacts associated with and accessible from each of at least one other surface of the connector that is adjacent to and essentially perpendicular to said first surface.

2. The connector of claim 1 wherein the collection of contacts comprises two sets of contacts and each set of contacts is associated with a different surface of the connector, and the different surfaces are opposite each other and adjacent to the first surface.

3. A connector including a cavity having a back surface opposite the opening of the cavity, a first side surface abutting the back surface, a second side surface abutting the back surface, and a third surface abutting the back surface and the two side surfaces, with a plurality of resilient metallic conductors extending from the third surface close to the opening of the cavity and extending, at an angle, away from the third surface and toward the back surface, the improvement comprising:

a collection of resilient metallic conductors extending from at least one of the side surfaces, at an angle, away from the side surface from which they extend and toward the back surface.

4. Apparatus comprising a connector coupled to a modem, wherein the connector comprises:

a cavity with a row of conductors associated with a first surface of the cavity, and a collection of secondary conductors associated with a second surface of the cavity that is perpendicular to the first surface.

5. Apparatus comprising a modem coupled to a connector, wherein the connector comprises:

a first conductor that carries a signal s1 to the modem and a signal s2 from the modem, a second conductor that carries the signal s1, effectively excluding the signal s2 and a third conductor that carries the signal s2 effectively excluding the signal s1.

6. The apparatus of claim 5 wherein the connector further includes at least one conductor for carrying a ground potential, and at least one conductor for carrying control signals.

7. The apparatus of claim 5 wherein the connector further includes at least one conductor for carrying a dc voltage.

8. An arrangement comprising:

two female modular telephone connectors;

a modem coupled to the two female modular connectors through a pair of conductors in each of the modular connectors that are coupled to analog telephone output lines of the modem, which output lines are adapted to communicate signals s1 to the modem and signals s2 from the modem;

the modem being further coupled to another conductor of one of the female modular connectors, which coupling is adapted to carry the signal s1, effectively excluding the signal s2; and the modem being further coupled to still another conductor of one of the female modular connectors, which coupling is adapted to carry essentially the signal s2, effectively excluding the signals s1; where each female modular connector includes a cavity having an opening, having two internal walls substantially perpendicular to the opening of the cavity and parallel to each other, having a third internal wall substantially perpendicular to the two internal walls and to the opening of the cavity and having a plurality of conductors associated therewith, and having detent means opposite the third wall.

9. A connector comprising:

a first male modular telephone connector connected to one end of a unitary cable;

a second male modular telephone connector connected to said one end of said unitary cable; and means for physically coupling the two male modular connectors in fixed relationship to each other; where the male modular telephone connector includes a first mating end, a second, opposed, conductor-receiving end, oppositely faced connector side walls that are substantially perpendicular to the first mating end, a third wall that is substantially perpendicular to the first mating end and to the oppositely faced side walls, and mating means opposite the third wall, where the third wall includes conductors within grooves parallel to the oppositely faced side walls.

10. A connector arrangement comprising:

a first male modular telephone connector connected to one end of a unitary cable; and a second male modular telephone connector connected to said one end of said unitary cable; where each of the male modular telephone connectors includes a first mating end, a second, opposed, conductor-receiving end, oppositely faced connector side walls that are substantially perpendicular to the first mating end, a third wall that is substantially perpendicular to the first mating end and to the oppositely faced side walls, and mating means opposite the third wall, where the third wall includes conductors within grooves parallel to the oppositely faced side walls.

11. The connector of claim 9 wherein said means for coupling permanently connects the two male modular connectors to form a single structure.

12. The connector of claim 11 wherein the means for coupling couples the two male modular connectors to each other at the back of said connectors, forming thereby a channel at the front of the connectors that allows the insertion of the connector into a pair of female modular telephone connectors; where a female modular telephone connector includes a cavity having an opening, having two internal walls substantially perpendicular to the opening of the cavity and parallel to each other, having a third internal wall substantially perpendicular to the two internal walls and to the opening of the cavity and having a plurality of conductors associated therewith, and having detent means opposite the third wall.

13. The apparatus of claim 12 wherein the connector further includes at least one conductor for carrying a ground potential, and at least one conductor for carrying control signals.

14. The apparatus of claim 12 wherein the connector further includes at least one conductor for carrying a dc voltage.

15. A connector comprising:

two male plugs, each having grooves on one surface and conductors in said grooves, and means for physically connecting the two plugs in a fixed relationship to each other to form a unitary modular plug connector.

* * * * *